US011645963B2

(12) United States Patent
Seo et al.

(10) Patent No.: US 11,645,963 B2
(45) Date of Patent: May 9, 2023

(54) GAMMA CORRECTION METHOD, GAMMA CORRECTION SYSTEM AND DISPLAY DEVICE

(71) Applicant: Samsung Display Co., Ltd., Yongin-Si (KR)

(72) Inventors: Young Jun Seo, Suwon-si (KR); Yongwoo Yi, Hwaseong-si (KR); Eunjung Lee, Yongin-si (KR); Sungchan Jo, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/530,326

(22) Filed: Nov. 18, 2021

(65) Prior Publication Data

US 2022/0327981 A1 Oct. 13, 2022

(30) Foreign Application Priority Data

Apr. 8, 2021 (KR) ..... 10-2021-0045818

(51) Int. Cl.
*G09G 3/20* (2006.01)

(52) U.S. Cl.
CPC ..... *G09G 3/2003* (2013.01); *G09G 2320/0276* (2013.01); *G09G 2320/0666* (2013.01); *G09G 2320/0693* (2013.01)

(58) Field of Classification Search
CPC ..... G09G 3/2003; G09G 2320/0276; G09G 2320/0666; G09G 2320/0693
See application file for complete search history.

(56) References Cited

U.S. PATENT DOCUMENTS 6,950,109 B2 * 9/2005 Deering ..... G09G 1/285 345/589
10,009,605 B1 * 6/2018 Yin ..... H01L 27/14621
11,361,474 B2 * 6/2022 Tanaka ..... H04N 9/69
(Continued)

FOREIGN PATENT DOCUMENTS

KR 10-1366163 B1 2/2014
KR 10-1523854 B1 5/2015
KR 10-1788681 B1 11/2017

OTHER PUBLICATIONS

D. MacLeod et al; "Fundamental Chromaticity Diagram With Physiological Axes—Part 1" Commission Internationale De L'Eclairage, 2006, 55 pages.

(Continued)

*Primary Examiner* — Kenneth Bukowski
(74) *Attorney, Agent, or Firm* — Innovation Counsel LLP

(57) ABSTRACT

A gamma correction method is disclosed that performs gamma correction for a display device. A plurality of correction matrices respectively corresponding to a plurality of spectrums of different test display devices is obtained. A spectrum of the display device is measured. A correction matrix corresponding to the spectrum of the display device is selected from the plurality of correction matrices. Tristimulus data of the display device are measured and the measured tristimulus data are converted into perception tristimulus data by using the selected correction matrix. The gamma correction for the display device is performed based on the perception tristimulus data.

20 Claims, 9 Drawing Sheets

(56) References Cited

U.S. PATENT DOCUMENTS

| | | | | |
|---|---|---|---|---|
| 2002/0122044 | A1* | 9/2002 | Deering | G06F 3/1431 348/E9.051 |
| 2006/0071937 | A1* | 4/2006 | Tin | G01J 3/462 345/591 |
| 2012/0056910 | A1* | 3/2012 | Safaee-Rad | G09G 3/3406 345/77 |
| 2014/0118387 | A1* | 5/2014 | Kim | H04N 9/69 345/590 |
| 2020/0043201 | A1* | 2/2020 | Tanaka | G09G 5/02 |
| 2020/0243042 | A1* | 7/2020 | Su | G09G 5/10 |

OTHER PUBLICATIONS

Viénot, F. et al; "Fundamental Chromaticity Diagram with Physiological Axes—Part 2: Spectral Luminous Efficiency Functions and Chromaticity Diagrams" Commission Internationale De L'Eclairage, 2015, 72 pages.

Eun-Su Kim; "Color Correction Method of Non-standard Display Using Standard Color Space" Journal of the Korea Academia-Industrial cooperation Society, vol. 16, No. 3 pp. 2151-2157, 2015.

* cited by examiner

FIG. 4

$$COR_MAT \cdot T_MEA_XYZ = REF_XYZ \quad 510$$

$$\begin{pmatrix} \sigma 11 & \sigma 12 & \sigma 13 \\ \sigma 21 & \sigma 22 & \sigma 23 \\ \sigma 31 & \sigma 32 & \sigma 33 \end{pmatrix} \cdot \begin{pmatrix} Xtest \\ Ytest \\ Ztest \end{pmatrix} = \begin{pmatrix} Xref \\ Yref \\ Zref \end{pmatrix}$$

$$\Downarrow$$

$$COR_MAT = pinv(T_MEA_XYZ) \cdot REF_XYZ \quad 530$$

$$\Downarrow$$

$$COR_MAT = (T_MEA_XYZ^{T} \cdot T_MEA_XYZ)^{-1} \cdot T_MEA_XYZ^{T} \cdot REF_XYZ \quad 550$$

SPECTRUM SIMILARITY = 91.3%

FIG. 7

800

$$COR_MAT \cdot MEA_XYZ = PCV_XYZ$$

$$\begin{pmatrix} \sigma 11 & \sigma 12 & \sigma 13 \\ \sigma 21 & \sigma 22 & \sigma 23 \\ \sigma 31 & \sigma 32 & \sigma 33 \end{pmatrix} \cdot \begin{pmatrix} Xmea \\ Ymea \\ Zmea \end{pmatrix} = \begin{pmatrix} Xpcv \\ Ypcv \\ Zpcv \end{pmatrix}$$

GAMMA CORRECTION METHOD, GAMMA CORRECTION SYSTEM AND DISPLAY DEVICE

CROSS-REFERENCE TO RELATED APPLICATION(S)

This application claims priority under 35 USC § 119 to Korean Patent Application No. 10-2021-0045818, filed on Apr. 8, 2021 in the Korean Intellectual Property Office (KIPO), the content of which is incorporated herein in its entirety by reference.

BACKGROUND

1. Field

The present inventive concept relates to display devices, and more particularly to gamma correction methods, gamma correction systems and display devices.

2. Description of the Related Art

Gamma correction may be performed such that a display device may have a gamma characteristic corresponding to a target gamma value, and thus an image quality of the display device may have a target quality level. In particular, a multi-time programming (MTP) operation for repeatedly performing correction of luminance or color coordinates for the display device may be performed as the gamma correction.

With respect to different display devices, once the display devices are corrected by the gamma correction or the MTP operation to have the same color coordinate, images having the same color coordinate of the display devices may be perceived as having the same color by a user even if the display devices have different spectrums (e.g., different light spectrums each representing light intensity over wavelength). This phenomenon may be referred to as a metamerism phenomenon.

Recently, a wide color gamut (WCG) display device where a distribution of each primary color has a narrow width in a light spectrum has been developed. However, even if these WCG display devices are corrected by the gamma correction or the MTP operation to have the same color coordinate, images having the same color coordinate of the WCG display devices may be perceived as having different colors by a user in a case where the WCG display devices have different spectrums. This phenomenon where images having the same color coordinate displayed by display devices having different spectrums are perceived as having different colors may be referred to as a metamerism failure.

SUMMARY

According to embodiments, there is provided a gamma correction method that performs gamma correction for a display device. In the gamma correction method, a plurality of correction matrices respectively corresponding to a plurality of spectrums of different test display devices is obtained, a spectrum of the display device is measured, a correction matrix corresponding to the spectrum of the display device is selected from the plurality of correction matrices, tristimulus data of the display device are measured, the measured tristimulus data are converted into perception tristimulus data by using the selected correction matrix, and the gamma correction for the display device is performed based on the perception tristimulus data.

In embodiments, to obtain the plurality of correction matrices, a reference color image may be displayed by a reference display device, image data for each of the test display devices may be adjusted such that each of the test display devices displays an image that is perceived to have a color identical to a color of the reference color image, test measured tristimulus data for each of the test display devices may be obtained, and the plurality of correction matrices respectively corresponding to the test display devices may be obtained based on the test measured tristimulus data of each of the test display devices and reference tristimulus data corresponding to the reference color image.

In embodiments, each of the plurality of correction matrices may be a matrix for converting the test measured tristimulus data of each of the test display devices into the reference tristimulus data.

In embodiments, each of the plurality of correction matrices may be calculated by using an equation, "COR_MAT·T_MEA_XYZ=REF_XYZ", where COR_MAT is each of the plurality of correction matrices, T_MEA_XYZ is a matrix representing the test measured tristimulus data, and REF_XYZ is a matrix representing the reference tristimulus data.

In embodiments, each of the plurality of correction matrices may be calculated by using an equation, "$COR_MAT=(T_MEA_XYZ^{T}\cdot T_MEA_XYZ)^{-1}\cdot T_MEA_XYZ^{T}\cdot REF_XYZ$", where COR_MAT is each of the plurality of correction matrices, T_MEA_XYZ is a matrix representing the test measured tristimulus data, and REF_XYZ is a matrix representing the reference tristimulus data.

In embodiments, to select the correction matrix corresponding to the spectrum of the display device, the correction matrix may be selected from the plurality of correction matrices according to at least one of a peak wavelength, a full width at half maximum and a spectrum similarity of the spectrum of the display device.

In embodiments, the measured tristimulus data may be converted into the perception tristimulus data by using an equation, "COR_MAT·MEA_XYZ=PCV_XYZ", where COR_MAT is the selected correction matrix, MEA_XYZ is a matrix representing the measured tristimulus data, and PCV_XYZ is a matrix representing the perception tristimulus data.

In embodiments, to perform the gamma correction for the display device based on the perception tristimulus data, whether the perception tristimulus data are within a target range may be determining, the perception tristimulus data may be obtained again by changing a gamma reference voltage of the display device when the perception tristimulus data are out of the target range, and gamma data representing the gamma reference voltage of the display device may be generated when the perception tristimulus data are within the target range.

According to embodiments, there is provided a gamma correction system that performs gamma correction for a display device. The gamma correction system includes a spectrum measurer configured to measure a spectrum of the display device, a tristimulus measurer configured to measure tristimulus data of the display device, and a gamma correction device configured to store a plurality of correction matrices respectively corresponding to a plurality of spectrums of different test display devices, to select a correction matrix corresponding to the spectrum of the display device from the plurality of correction matrices, to convert the measured tristimulus data into perception tristimulus data by using the selected correction matrix, and to perform the gamma correction for the display device based on the perception tristimulus data.

In embodiments, the gamma correction device may include a correction matrix storing block configured to store the plurality of correction matrices respectively corresponding to the plurality of spectrums, a correction matrix selecting block configured to select the correction matrix according to the spectrum of the display device, a tristimulus converting block configured to convert the measured tristimulus data into the perception tristimulus data by using the selected correction matrix, and a gamma correction block configured to perform the gamma correction based on the perception tristimulus data.

In embodiments, test measured tristimulus data for each of the test display devices may be obtained when each of the test display devices displays an image that is perceived to have a color identical to a color of a reference color image displayed by a reference display device, and the plurality of correction matrices respectively corresponding to the test display devices may be obtained based on the test measured tristimulus data of each of the test display devices and reference tristimulus data corresponding to the reference color image.

In embodiments, each of the plurality of correction matrices may be a matrix for converting the test measured tristimulus data of each of the test display devices into the reference tristimulus data.

In embodiments, each of the plurality of correction matrices may be calculated by using an equation, "COR_MAT·T_MEA_XYZ=REF_XYZ", where COR_MAT is each of the plurality of correction matrices, T_MEA_XYZ is a matrix representing the test measured tristimulus data, and REF_XYZ is a matrix representing the reference tristimulus data.

In embodiments, each of the plurality of correction matrices may be calculated by using an equation, "$COR_MAT=(T_MEA_XYZ^{T}\cdot T_MEA_XYZ)^{-1}\cdot T_MEA_XYZ^{T}\cdot REF_XYZ$", where COR_MAT is each of the plurality of correction matrices, T_MEA_XYZ is a matrix representing the test measured tristimulus data, and REF_XYZ is a matrix representing the reference tristimulus data.

In embodiments, the gamma correction device may select the correction matrix from the plurality of correction matrices according to at least one of a peak wavelength, a full width at half maximum and a spectrum similarity of the spectrum of the display device.

In embodiments, the gamma correction device may convert the measured tristimulus data into the perception tristimulus data by using an equation, "COR_MAT·MEA_XYZ=PCV_XYZ", where COR_MAT is the selected correction matrix, MEA_XYZ is a matrix representing the measured tristimulus data, and PCV_XYZ is a matrix representing the perception tristimulus data.

In embodiments, the gamma correction device may be further configured to determine whether the perception tristimulus data are within a target range, to obtain again the perception tristimulus data by changing a gamma reference voltage of the display device when the perception tristimulus data are out of the target range, and to generate gamma data representing the gamma reference voltage of the display device when the perception tristimulus data are within the target range.

According to embodiments, there is provided a display device including a display panel including a plurality of pixels, a scan driver configured to provide scan signals to the plurality of pixels, a data driver configured to provide data signals to the plurality of pixels, a controller configured to control the scan driver and the data driver, a sensor configured to measure a spectrum and tristimulus data of the display device, and a gamma correction device configured to store a plurality of correction matrices respectively corresponding to a plurality of spectrums of different test display devices, to select a correction matrix corresponding to the spectrum of the display device from the plurality of correction matrices, to convert the measured tristimulus data into perception tristimulus data by using the selected correction matrix, and to perform gamma correction for the display device based on the perception tristimulus data.

In embodiments, the gamma correction device may include a correction matrix storing block configured to store the plurality of correction matrices respectively corresponding to the plurality of spectrums, a correction matrix selecting block configured to select the correction matrix according to the spectrum of the display device, a tristimulus converting block configured to convert the measured tristimulus data into the perception tristimulus data by using the selected correction matrix, and a gamma correction block configured to perform the gamma correction based on the perception tristimulus data.

In embodiments, the gamma correction device may convert the measured tristimulus data into the perception tristimulus data by using an equation, "COR_MAT·MEA_XYZ=PCV_XYZ", where COR_MAT is the selected correction matrix, MEA_XYZ is a matrix representing the measured tristimulus data, and PCV_XYZ is a matrix representing the perception tristimulus data.

As described above, in a gamma correction method, a gamma correction system and a display device according to embodiments, a correction matrix may be selected according to a measured spectrum of the display device, measured tristimulus data may be converted into perception tristimulus data by using the selected correction matrix, and gamma correction for the display device may be performed based on the perception tristimulus data. Accordingly, a metamerism failure where images displayed by different display devices are determined to have substantially the same color coordinate by a measurer (e.g., a tristimulus measurer or a colorimetry measurer), but are perceived to have different colors by a user may be prevented.

BRIEF DESCRIPTION OF THE DRAWINGS

Illustrative, non-limiting embodiments will be more clearly understood from the following detailed description in conjunction with the accompanying drawings.

FIG. 4 is a diagram for describing an example of an equation for generating a correction matrix for each test display device.

FIG. 7 is a diagram for describing an example of an equation for converting measured tristimulus data into perception tristimulus data.

DETAILED DESCRIPTION OF THE EMBODIMENTS

Some embodiments of the inventive concept provide a gamma correction method capable of preventing a metamerism failure. Some embodiments of the inventive concept provide a gamma correction system capable of preventing a metamerism failure. Some embodiments of the present inventive concept provide a display device capable of preventing a metamerism failure.

Hereinafter, embodiments of the present inventive concept will be explained in detail with reference to the accompanying drawings.

Figure 1:
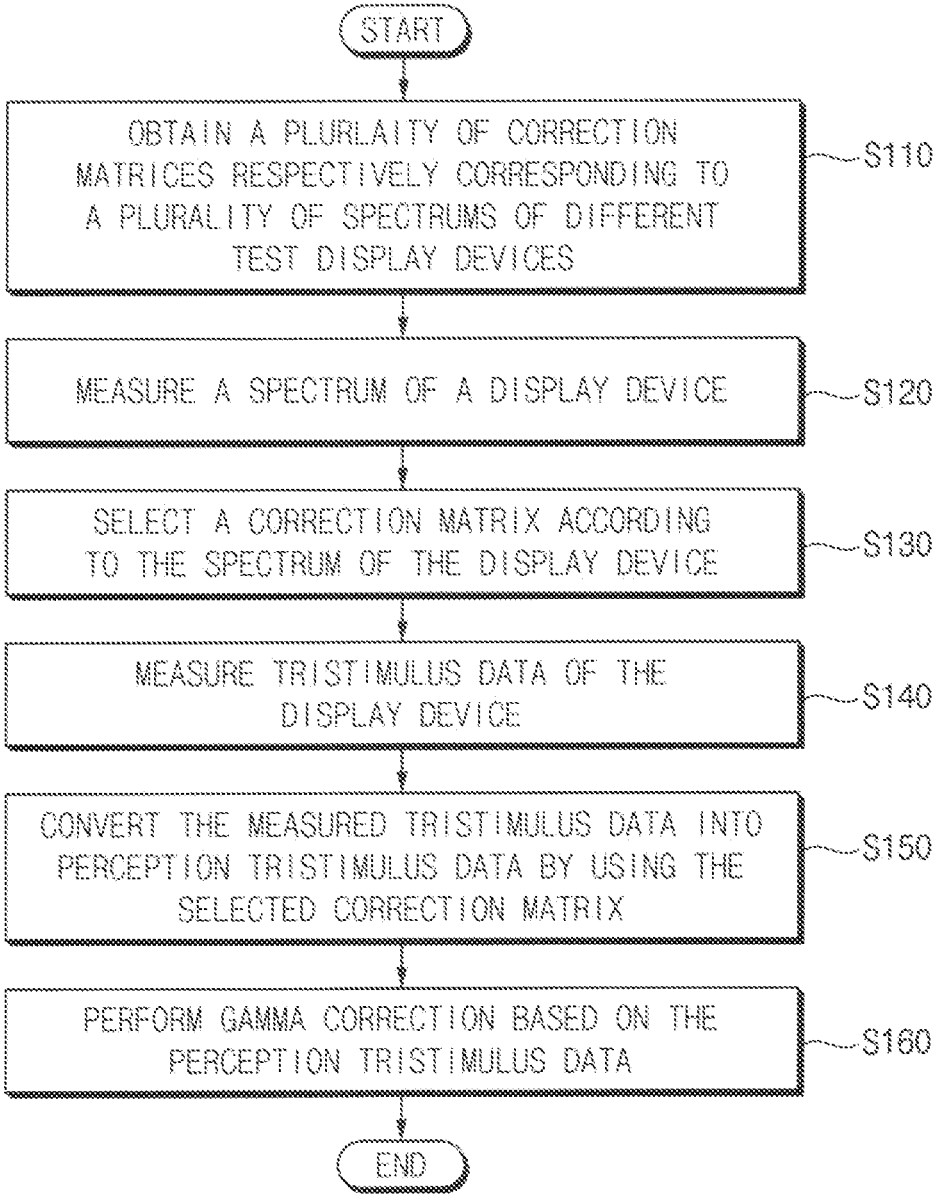
FIG. 1 is a flowchart illustrating a gamma correction method that performs gamma correction for a display device according to embodiments.
Figure 2:
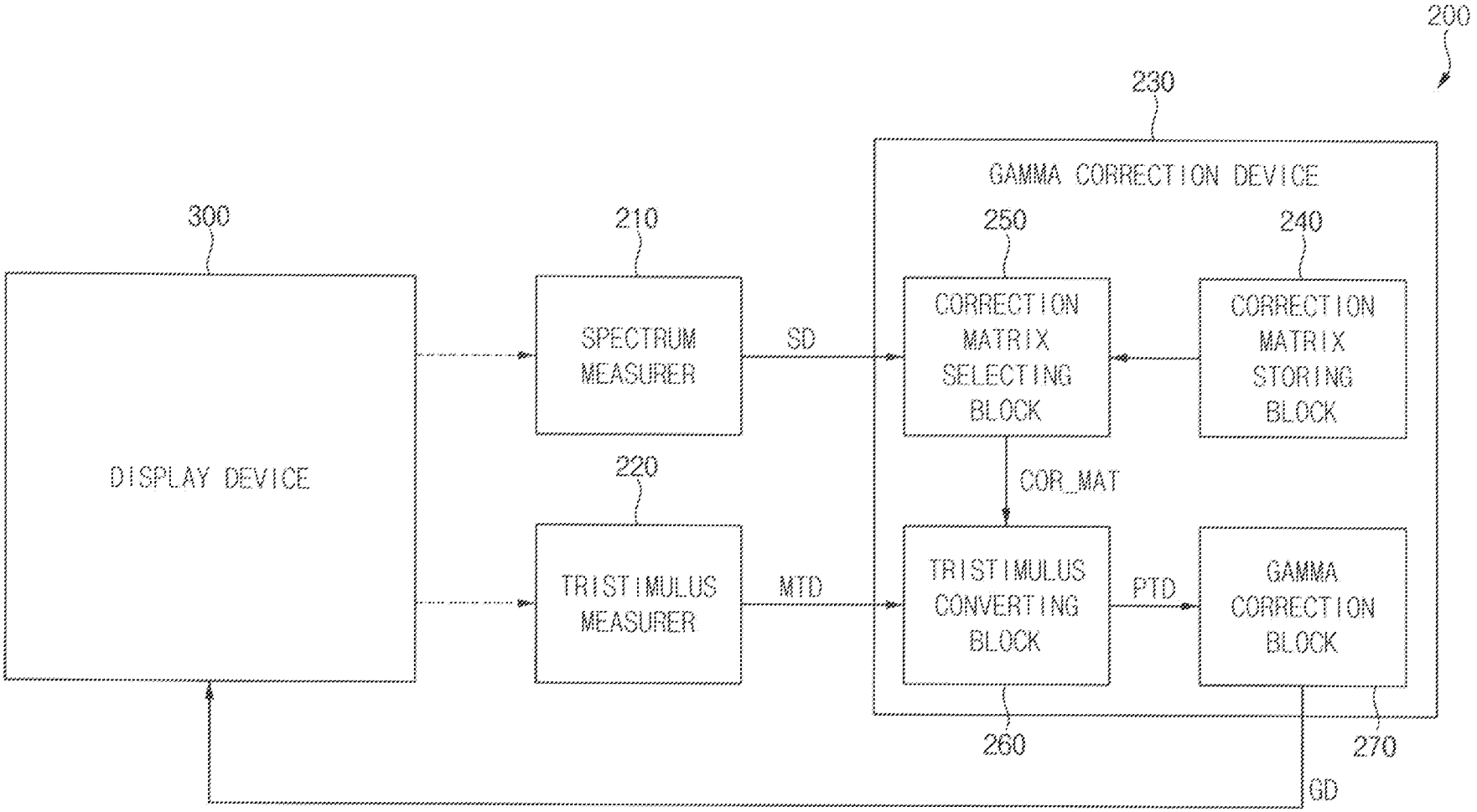
FIG. 2 is a block diagram illustrating a gamma correction system that performs gamma correction for a display device according to embodiments.
Figure 3:
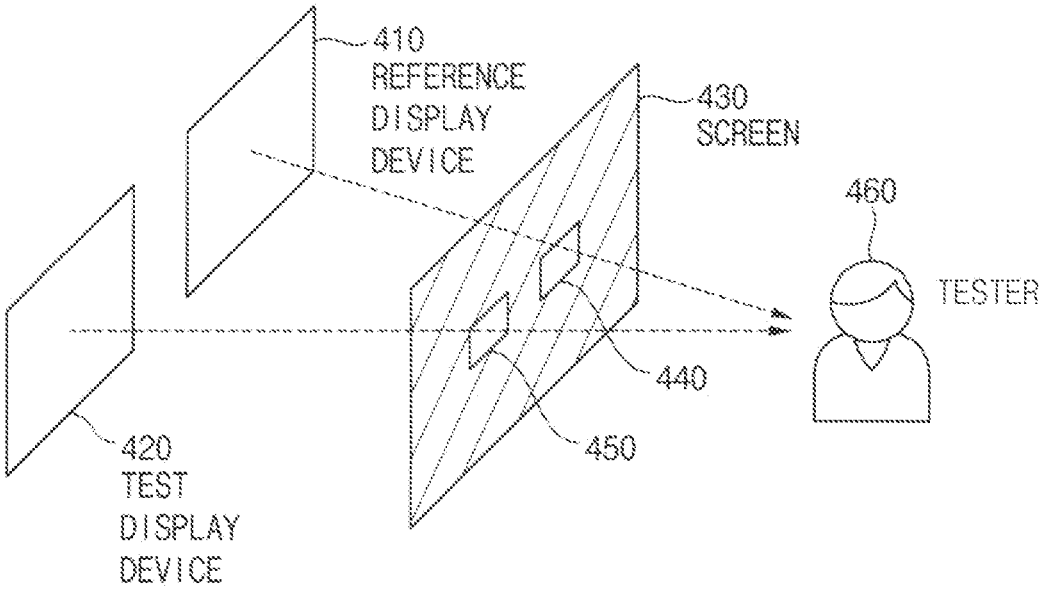
FIG. 3 is a diagram for describing an example of a perception test for generating a correction matrix for each test display device.
Figure 5:
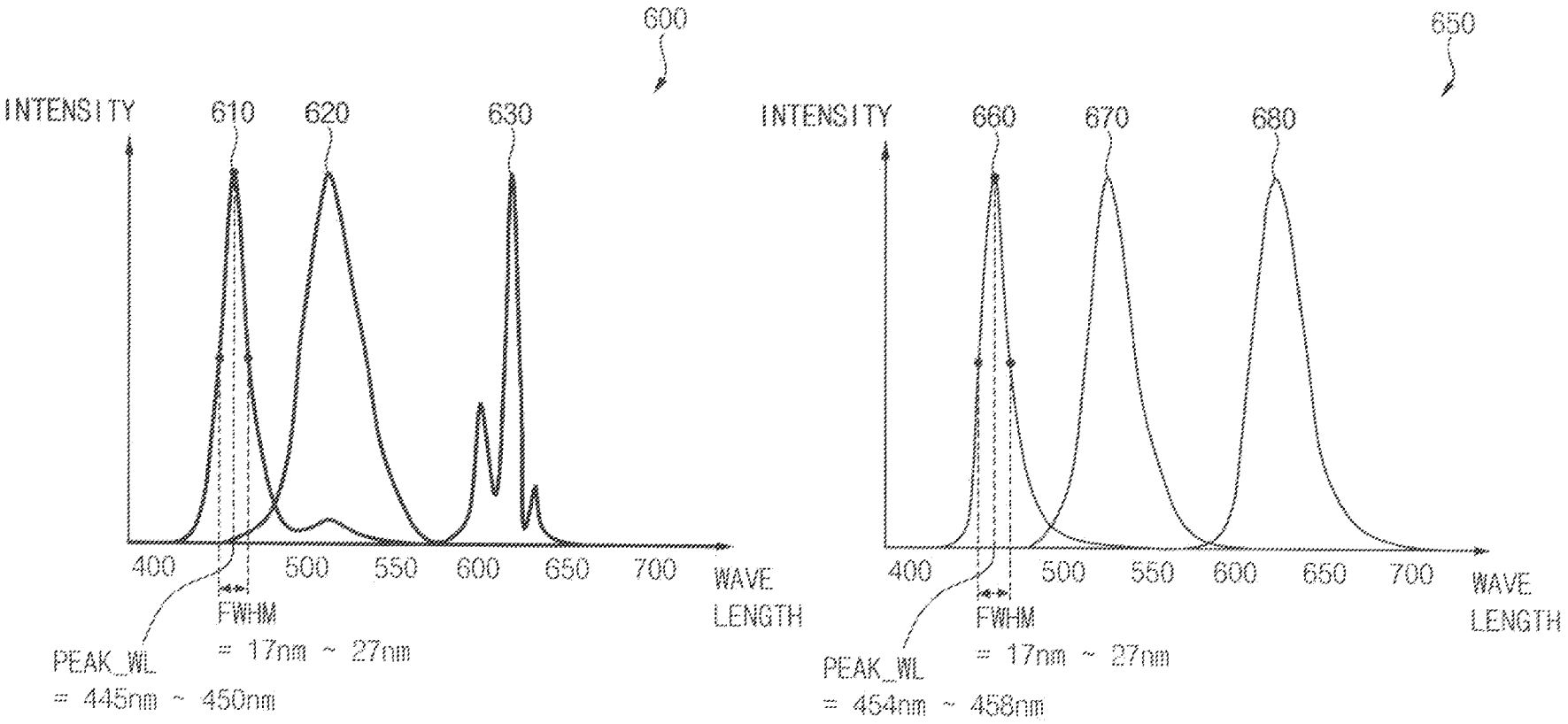
FIG. 5 is a diagram illustrating an example of spectrums of different display devices.
Figure 6:
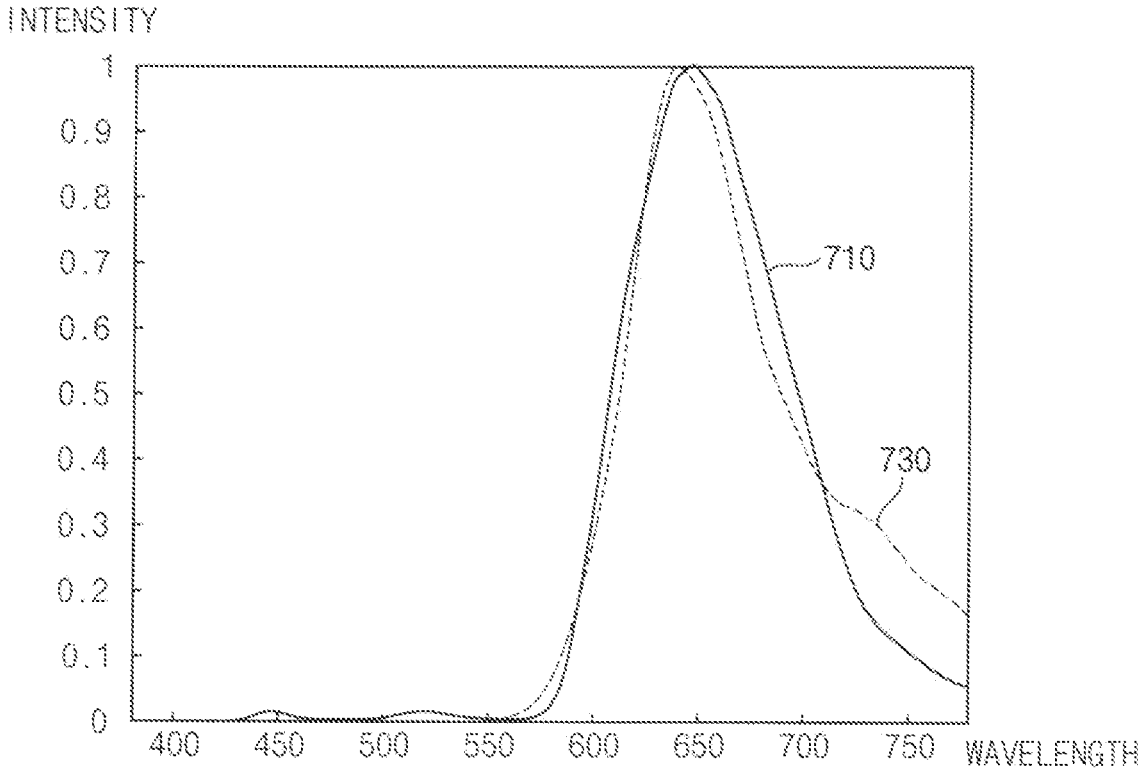
FIG. 6 is a diagram illustrating an example of a spectrum similarity between spectrums of different display devices.

FIG. 1 is a flowchart illustrating a gamma correction method that performs gamma correction for a display device according to embodiments. FIG. 2 is a block diagram illustrating a gamma correction system that performs gamma correction for a display device according to embodiments. FIG. 3 is a diagram for describing an example of a perception test for generating a correction matrix for each test display device. FIG. 4 is a diagram for describing an example of an equation for generating a correction matrix for each test display device. FIG. 5 is a diagram illustrating an example of spectrums of different display devices. FIG. 6 is a diagram illustrating an example of a spectrum similarity between spectrums of different display devices. And, FIG. 7 is a diagram for describing an example of an equation for converting measured tristimulus data into perception tristimulus data.

Referring to FIGS. 1 and 2, a gamma correction system 200 according to embodiments may perform a gamma correction method of FIG. 1 which performs gamma correction for a display device 300. The gamma correction system 200 may include a spectrum measurer 210 that generates spectrum data SD by measuring a spectrum of the display device 300, a tristimulus measurer 220 that measures tristimulus data MTD of the display device 300, and a gamma correction device 230 that performs the gamma correction for the display device 300. In some embodiments, the gamma correction device 230 may include a correction matrix storing block 240 that stores a plurality of correction matrices respectively corresponding to a plurality of spectrums of different test display devices, a correction matrix selecting block 250 that selects a correction matrix COR_MAT according to the spectrum of the display device 300, a tristimulus converting block 260 that converts the measured tristimulus data MTD into perception tristimulus data PTD by using the selected correction matrix COR_MAT, and a gamma correction block 270 that performs the gamma correction based on the perception tristimulus data PTD.

In the gamma correction method according to embodiments, the plurality of correction matrices respectively corresponding to the plurality of spectrums of the different test display devices may be obtained (S110). The different test display devices may be display devices having different spectrums (e.g., different light spectrums each representing light intensity over wavelength), and may be different models of display devices, or different display devices of the same model. In some embodiments, the test display devices may include a wide color gamut (WCG) display device having a wide color gamut, in which a distribution of each primary color has a narrow width in a light spectrum.

In some embodiments, to obtain the correction matrix of each test display device 420, as illustrated in FIG. 3, a reference color image may be displayed by a reference display device 410, and image data for each test display device 420 may be adjusted such that each test display device 420 displays an image that is perceived to have a color substantially the same as (or identical to) a color of the reference color image. For example, a tester (or a testing person) 460 may view the reference color image displayed by the reference display device 410 through a first penetration window 440 of a screen 430, and may view the image displayed by the test display device 420 through a second penetration window 450 of the screen 430. For example, the reference color image may be, but not be limited to, a white image, a red image, a green image or a blue image. Until the color of the image of the test display device 420 perceived by the tester 460 becomes substantially the same as the color of the reference color image of the reference display device 410 perceived by the tester 460, the image data for the test display device 420 may adjusted, and the test display device 420 may display the image based on the adjusted image data. Although FIG. 3 illustrates an example where the image of the test display device 420 is adjusted, a method of adjusting the image of the test display device 420 is not limited to the example of FIG. 3.

Once the color of the image of the test display device 420 perceived by the tester 460 becomes substantially the same as the color of the reference color image of the reference display device 410 perceived by the tester 460, test measured tristimulus data for the test display device 420 displaying the image may be obtained. For example, the test measured tristimulus data of the test display device 420 may be obtained by a tristimulus measurer, such as a colorimetry measurer or a colorimeter.

The correction matrix of the test display device 420 may be obtained based on the test measured tristimulus data of the test display device 420 and reference tristimulus data corresponding to the reference color image of the reference display device 410. For example, the reference color image may be a white image, a red image, a green image or a blue image, and the reference tristimulus data may be predetermined tristimulus data or target tristimulus data for the white image, the red image, the green image or the blue image.

In some embodiments, the correction matrix of the test display device 420 may be a matrix for converting the test measured tristimulus data of the test display device 420 into the reference tristimulus data. For example, as illustrated in FIG. 4, the correction matrix of the test display device 420 may be calculated by using an equation 510, or "COR_MAT·T_MEA_XYZ=REF_XYZ". Here, COR_MAT may be the correction matrix, T_MEA_XYZ may be a matrix representing the test measured tristimulus data of the test display device 420, and REF_XYZ may be a matrix representing the reference tristimulus data. For example, the correction matrix COR_MAT may be a 3*3 matrix including 3*3 entries (or elements) $\sigma 11$, $\sigma 12$, $\sigma 13$, $\sigma 21$, $\sigma 22$, $\sigma 23$, $\sigma 31$, $\sigma 32$ and $\sigma 33$, the matrix T_MEA_XYZ representing the test measured tristimulus data may be a 3*1 matrix including an X entry Xtest of the test measured tristimulus data, a Y entry Ytest of the test measured tristimulus data and a Z entry Ztest of the test measured tristimulus data, and the matrix REF_XYZ representing the reference tristimulus data may be a 3*1 matrix including an X entry Xref of the reference tristimulus data, a Y entry Yref of the reference tristimulus data and a Z entry Zref of the reference tristimulus data.

The equation 510 may be converted into an equation 530, or "COR_MAT=pinv(T_MEA_XYZ)·REF_XYZ". Here, pinv(T_MEA_XYZ) may be a pseudo inverse matrix of T_MEA_XYZ. Further, the equation 530 may be converted into an equation 550, or "COR_MAT=$(T_MEA_XYZ^T \cdot T_MEA_XYZ)^{-1} \cdot T_MEA_XYZ^T \cdot REF_XYZ$". Here, $T_MEA_XYZ^T$ may be a transposed matrix of T_MEA_XYZ, and $(T_MEA_XYZ^T\ T_MEA_XYZ)^{-1}$ may be an inverse matrix of $(T_MEA_XYZ^T \cdot T_MEA_XYZ)$.

In this manner, the plurality of correction matrices of the plurality of test display devices 420 may be obtained, and the plurality of correction matrices may be stored in the correction matrix storing block 240 of the gamma correction device 230 of the gamma correction system 200. In some embodiments, the correction matrix storing block 240 may be implemented with, but not limited to, a nonvolatile memory device, such as a flash memory device.

Referring again to FIGS. 1 and 2, the spectrum measurer 210 of the gamma correction system 200 may generate the spectrum data SD representing the spectrum of the display device 300 by measuring the spectrum of the display device 300 (S120), and the correction matrix selecting block 250 of the gamma correction device 230 may select the correction matrix COR_MAT corresponding to the measured spectrum of the display device 300 from the plurality of correction matrices stored in the correction matrix storing block 240 (S130). For example, the spectrum measurer 210 may be, but not be limited to, a spectrometer. In some embodiments, the correction matrix selecting block 250 may select the correction matrix COR_MAT according to at least one of a peak wavelength, a full width at half maximum and a spectrum similarity of the spectrum of the display device 300.

For example, as illustrated in FIG. 5, a first display device may have a first spectrum 600 representing light intensity over wavelength, and a second display device may have a second spectrum 650 different from the first spectrum 600. In an example, the first display device may be, but not be limited to, a normal display device, the second display device may be, but not be limited to, a WCG display device having a wide color gamut, in which a distribution 660, 670 or 680 of each primary color has a narrow width in a light spectrum. Further, the first spectrum 600 may include, but not limited to, a first blue distribution 610, a first green distribution 620 and a first red distribution 630, and the second spectrum 650 may include, but not limited to, a second blue distribution 660, a second green distribution 670 and a second red distribution 680.

In some embodiments, the spectrum measurer 210 may generate the spectrum data SD representing the peak wavelength PEAK_WK or the full width at half maximum FWHM of the first blue distribution 610 of the first spectrum 600 with respect to the first display device, and may generate the spectrum data SD representing the peak wavelength PEAK_WK or the full width at half maximum FWHM of the second blue distribution 660 of the second spectrum 650 with respect to the second display device. For example, the peak wavelength PEAK_WK of the first blue distribution 610 of the first display device may range from about 445 nm to about 450 nm, the full width at half maximum FWHM of the first blue distribution 610 of the first display device may range from about 17 nm to about 27 nm, the peak wavelength PEAK_WK of the second blue distribution 660 of the second display device may range from about 454 nm to about 458 nm, and the full width at half maximum FWHM of the second blue distribution 660 of the second display device may range from about 17 nm to about 27 nm In this case, the correction matrix selecting block 250 may select a first correction matrix COR_MAT suitable for the first display device in a first case where the spectrum data SD represent the peak wavelength PEAK_WK less than a reference peak wavelength (e.g., about 453 nm), and may select a second correction matrix COR_MAT suitable for the second display device in a second case where the spectrum data SD represent the peak wavelength PEAK_WK greater than the reference peak wavelength. However, a method of selecting the correction matrix COR_MAT for the display device 300 by the correction matrix selecting block 250 is not limited to the example described above.

In another example, as illustrated in FIG. 6, as well as or instead of the peak wavelength PEAK_WK or the full width at half maximum FWHM, the spectrum similarity may be used in selecting the correction matrix COR_MAT. In some embodiments, a spectrum 730 of the display device 300 may be compared with a spectrum 710 of each of the test display devices for which the plurality of correction matrices is obtained. FIG. 6 illustrates an example where the spectrum 730 of the display device 300 and the spectrum 710 of one test display device have a spectrum similarity of about 91.3%. The correction matrix of the test display device of which the spectrum 710 has the highest spectrum similarity with respect to the spectrum 730 of the display device 300 may be selected as the correction matrix COR_MAT for the display device 300. However, a method of selecting the correction matrix COR_MAT is not limited to the example described above.

Referring again to FIGS. 1 and 2, the tristimulus measurer 220 of the gamma correction system 200 may measure the tristimulus data MTD of the display device 300 (S140), and the tristimulus converting block 260 of the gamma correction device 230 may convert the measured tristimulus data MTD into the perception tristimulus data PTD by using the selected correction matrix COR_MAT (S150). For example, the tristimulus measurer 220 may be, but not be limited to, a colorimetry measurer or a colorimeter.

In some embodiments, as illustrated in FIG. 7, the tristimulus converting block 260 may convert the measured tristimulus data MTD into the perception tristimulus data PTD by using an equation 800, or "COR_MAT·MEA_XYZ=PCV_XYZ". Here, COR_MAT may be the selected correction matrix, MEA_XYZ may be a matrix representing the tristimulus data MTD measured by the tristimulus measurer 220, and PCV_XYZ may be a matrix representing the perception tristimulus data PTD. For example, the selected correction matrix COR_MAT may be a 3*3 matrix including 3*3 entries (or elements) σ11, σ12, σ13, σ21, σ22, σ23, σ31, σ32 and σ33, the matrix MEA_XYZ representing the measured tristimulus data MTD may be a 3*1 matrix including an X entry Xmea of the measured tristimulus data MTD, a Y entry Ymea of the measured tristimulus data MTD and a Z entry Zmea of the measured tristimulus data MTD, and the matrix PCV_XYZ representing the perception tristimulus data PTD may be a 3*1 matrix including an X entry Xpcv of the perception tristimulus data PTD, a Y entry Ypcv of the perception tristimulus data PTD and a Z entry Zpcv of the perception tristimulus data PTD. By the equation 800, the X entry Xpcv of the perception tristimulus data PTD may be calculated by "σ11*Xmea+σ12*Ymea+σ13*Zmea", the Y entry Ypcv of the perception tristimulus data PTD may be calculated by "σ21*Xmea+σ22*Ymea+σ23*Zmea", and the Z entry Zpcv of the perception tristimulus data PTD may be calculated by "σ31*Xmea+σ32*Ymea+σ33*Zmea".

In other embodiments, the correction matrix COR_MAT may be implemented with a lookup table (LUT) that stores the measured tristimulus data MTD and the perception tristimulus data PTD corresponding to the measured tristimulus data MTD. For example, the tristimulus converting block 260 may read the perception tristimulus data PTD corresponding to the measured tristimulus data MTD from the LUT, and may provide the read perception tristimulus data PTD to the gamma correction block 270.

Referring again to FIGS. 1 and 2, the gamma correction block 270 of the gamma correction device 230 of the gamma correction system 200 may perform the gamma correction that generates or updates gamma data GD for the display device 300 based on the perception tristimulus data PTD (S160).

In some embodiments, the gamma correction block 270 may determine whether the perception tristimulus data PTD are within a target range (e.g., a target luminance range or a target color coordinate range). When the perception tristimulus data PTD are out of the target range, the gamma correction device 230 may change a gamma reference voltage (or a reference current) of the display device 300, may measure again the tristimulus data MTD of the display device 300 by using the tristimulus measurer 220, and may convert again the measure tristimulus data MTD into the perception tristimulus data PTD by using the correction matrix COR_MAT. When the perception tristimulus data PTD are within the target range, the gamma correction block 270 may generate the gamma data GD representing the gamma reference voltage (or the reference current) of the display device 300 corresponding to the perception tristimulus data PTD within the target range. The gamma correction system 200 may write the gamma data GD into a gamma LUT of the display device 300, and the display device 300 may display an image based on the gamma data GD.

In a case where a conventional gamma correction system performs gamma correction or a multi-time programming (MTP) operation for the display device 300 (e.g., the WCG display device), even if the gamma correction or the MTP operation is performed such that the WCG display device has a target color coordinate, an image displayed by the WCG display device may not be perceived to have a desired color by a user. In other words, even if the gamma correction or the MTP operations for display devices having different spectrums are performed by the conventional gamma correction system such that the display devices have the target color coordinate, or the same color coordinate, images displayed by the display devices may be perceived as having different colors by the user, and this phenomenon may be referred to as a metamerism failure.

However, in the gamma correction method and the gamma correction system 200 according to embodiments, the correction matrix COR_MAT may be selected according to the measured spectrum of the display device 300, the measured tristimulus data MTD may be converted into the perception tristimulus data PTD by using the selected correction matrix COR_MAT, and the gamma correction for the display device 300 may be performed based on the perception tristimulus data PTD. Since the correction matrix COR_MAT is a matrix extracted to match a color coordinate perceived by the tester 460 and a color coordinate used in the gamma correction or the MTP operation by the perception test illustrated in FIG. 3, the perception tristimulus data PTD converted from the measured tristimulus data MTD by using the correction matrix COR_MAT may be tristimulus data having the color coordinate in the gamma correction or the MTP operation matched with the color coordinate of the display device 300 perceived by a user. Accordingly, an image displayed by the display device 300 for which the gamma correction is performed by the gamma correction method and the gamma correction system 200 according to embodiments may be perceived to have the desired color by the user, and the metamerism failure may be prevented by the gamma correction method and the gamma correction system 200 according to embodiments.

Figure 8:
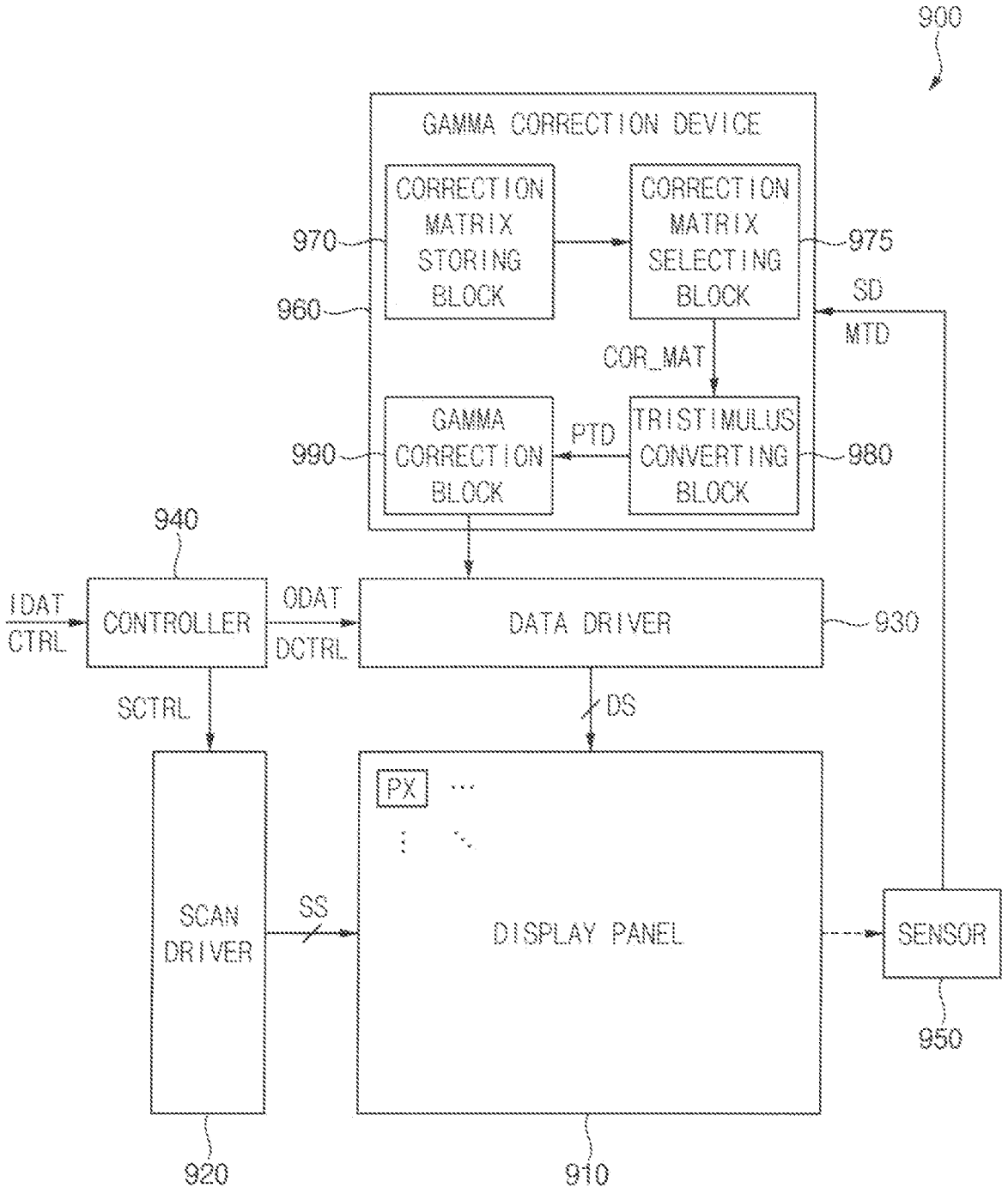
FIG. 8 is a block diagram illustrating a display device according to embodiments.

FIG. 8 is a block diagram illustrating a display device according to embodiments.

Referring to FIG. 8, a display device 900 according to embodiments may perform a gamma correction method of FIG. 1 which performs gamma correction for the display device 900. The display device 900 may include a display panel 910 that includes a plurality of pixels PX, a scan driver 920 that provides scan signals SS to the plurality of pixels PX, a data driver 930 that provides data signals DS to the plurality of pixels PX, a sensor 950 that measures a spectrum or tristimulus data of the display device 900, a gamma correction device 960 that performs the gamma correction for the display device 900, and a controller 940 that controls an operation of the display device 900.

The display panel 910 may include the plurality of pixels PX that displays an image. In some embodiments, each pixel PX may include a self-luminous element. For example, each pixel PX may include, as the self-luminous element, an organic light emitting diode (OLED), and the display panel 910 may be an OLED display panel. In another example, each pixel PX may include, as the self-luminous element, a quantum dot light emitting diode (QD-LED), and the display panel 910 may be a QD-LED display panel. In other embodiments, the display panel 910 may be a liquid crystal display (LCD) panel, or any other suitable display panel.

The scan driver 920 may generate the scan signals SS based on a scan control signal SCTRL received from the controller 940, and may sequentially provide the scan signals SS to the plurality of pixels PX on a row-by-row basis. In some embodiments, the scan control signal SCTRL may include, but not limited to, a scan start signal and a scan clock signal. In some embodiments, the scan driver 920 may be integrated or formed in a peripheral portion of the display panel 910. In other embodiments, the scan driver 920 may be implemented with one or more integrated circuits.

The data driver 930 may generate the data signals DS based on a data control signal DCTRL and output image data ODAT received from the controller 940, and may provide the data signals DS corresponding to the output image data ODAT to the plurality of pixels PX. In some embodiments, the data control signal DCTRL may include, but not limited to, an output data enable signal, a horizontal start signal and a load signal. In some embodiments, the data driver 930, the gamma correction device 960 and the controller 940 may be implemented with a single integrated circuit. In other embodiments, the data driver 930, the gamma correction device 960 and the controller 940 may be implemented with two or more separated integrated circuits.

The controller 940 (e.g., a timing controller (TCON)) may receive input image data IDAT and a control signal CTRL from an external host processor (e.g., a graphics processing unit (GPU), an application processor (AP) or a graphics card). In some embodiments, the input image data IDAT may be RGB image data including red image data, green image data and blue image data. Further, in some embodiments, the control signal CTRL may include, but not limited to, a vertical synchronization signal, a horizontal synchronization signal, an input data enable signal, a master clock signal, etc. The controller 940 may generate the output image data ODAT, the data control signal DCTRL and the scan control signal SCTRL based on the input image data IDAT and the control signal CTRL. The controller 940 may control an operation of the data driver 930 by providing the output image data ODAT and the data control signal DCTRL to the data driver 930, and may control an operation of the scan driver 920 by providing the scan control signal SCTRL to the scan driver 920.

The sensor 950 may measure the spectrum or the tristimulus data of the display device 900. In some embodiments, the sensor 950 may include, but not limited to, a spectrum measurer or a spectrometer for measuring the spectrum or the tristimulus data of the display device 900. In some embodiments, the sensor 950 may further include, but not limited to, a tristimulus measurer, such as a colorimetry measurer or a colorimeter.

The gamma correction device 960 may store a plurality of correction matrices respectively corresponding to a plurality of spectrums of different test display devices, may select a correction matrix COR_MAT corresponding to the spectrum of the display device 900 measured by the sensor 950 from the plurality of correction matrices, may convert the measured tristimulus data into perception tristimulus data PTD by using the selected correction matrix COR_MAT, and may perform the gamma correction for the display device 900 based on the perception tristimulus data PTD. In some embodiments, the gamma correction device 960 may include a correction matrix storing block 970, a correction matrix selecting block 975, a tristimulus converting block 980 and a gamma correction block 990.

The correction matrix storing block 970 may store the plurality of correction matrices respectively corresponding to the plurality of spectrums of the different test display device. For example, the plurality of correction matrices may be obtained by a perception test illustrated in FIG. 3. Thus, each of the plurality of correction matrices may be a matrix extracted to match a color coordinate perceived by a tester and a color coordinate used in gamma correction or an MTP operation. In some embodiments, the correction matrix storing block 970 may be implemented with, but not limited to, a nonvolatile memory device, such as a flash memory device.

The correction matrix selecting block 975 may select the correction matrix COR_MAT according to the spectrum of the display device 900 measured by the sensor 950 from the plurality of correction matrices stored in the correction matrix storing block 970. Thus, the selected correction matrix COR_MAT may be suitable for the display device 900 having the spectrum. In some embodiments, the correction matrix selecting block 975 may select the correction matrix COR_MAT according to at least one of a peak wavelength, a full width at half maximum and a spectrum similarity of the spectrum of the display device 900.

The tristimulus converting block 980 may convert the tristimulus data measured by the sensor 950 into the perception tristimulus data PTD by using the selected correction matrix COR_MAT. In some embodiments, the tristimulus converting block 980 may convert the measured tristimulus data into the perception tristimulus data PTD by using an equation, "COR_MAT·MEA_XYZ=PCV_XYZ". Here, COR_MAT may be the selected correction matrix, MEA_XYZ may be a matrix representing the tristimulus data of the display device 900 measured by the sensor 950, and PCV_XYZ may be a matrix representing the perception tristimulus data. In other embodiments, the correction matrix COR_MAT may be implemented in a form of a lookup table (LUT), and the tristimulus converting block 980 may read the perception tristimulus data PTD corresponding to the measured tristimulus data from the LUT to provide the read perception tristimulus data PTD to the gamma correction block 990.

The gamma correction block 990 may perform the gamma correction based on the perception tristimulus data PTD. In some embodiments, the gamma correction block 990 may determine whether the perception tristimulus data PTD are within a target range (e.g., a target luminance range or a target color coordinate range), and may generate or update gamma data stored in a gamma LUT based on a result of the determination. In some embodiments, the gamma LUT may be located inside, but not limited to, the data driver 930.

As described above, in the display device 900 according to embodiments, the correction matrix COR_MAT may be selected according to the spectrum of the display device 900, the tristimulus data measured by the sensor 950 may be converted into the perception tristimulus data PTD by using the selected correction matrix COR_MAT, and the gamma correction for the display device 900 may be performed based on the perception tristimulus data PTD. Accordingly, an image displayed by the display device 900 according to embodiments may be perceived to have a desired color by a user, and a metamerism failure may be prevented.

Figure 9:
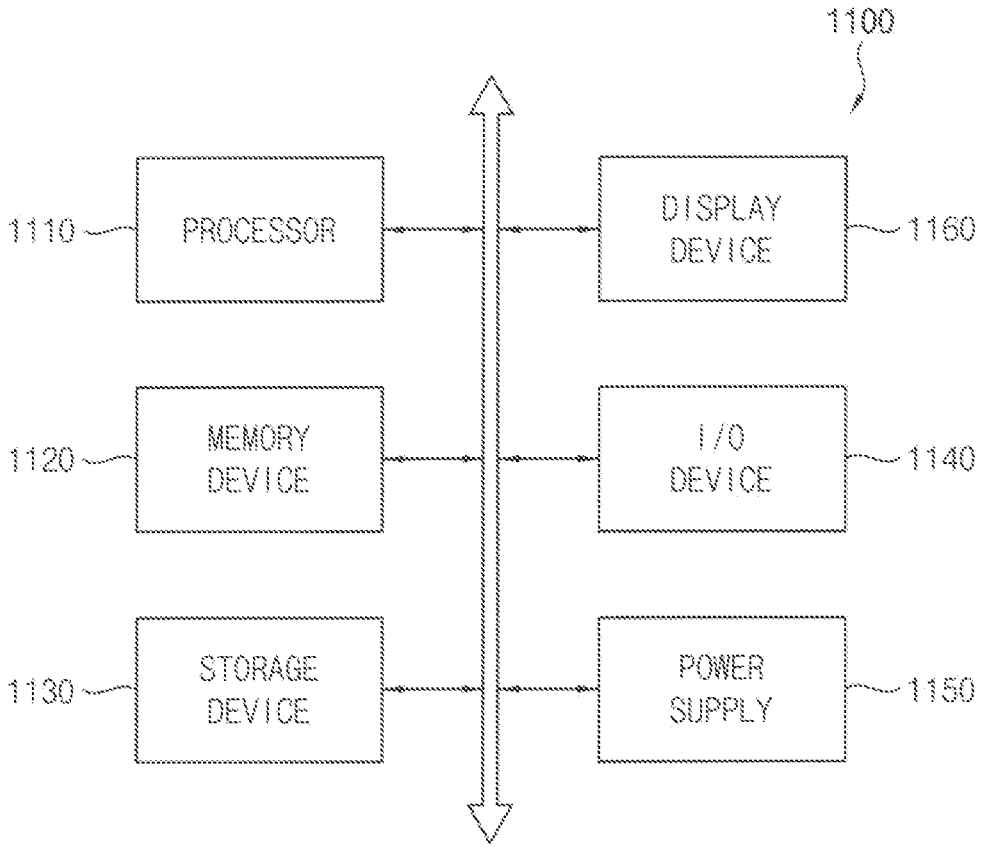
FIG. 9 is a block diagram illustrating an electronic device including a display device according to embodiments.

FIG. 9 is a block diagram illustrating an electronic device including a display device according to embodiments.

Referring to FIG. 9, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

With respect to the display device 1160, a correction matrix may be selected according to a spectrum of the display device 1160, tristimulus data measured for the display device 1160 may be converted into perception tristimulus data by using the selected correction matrix, and gamma correction for the display device 1160 may be performed based on the perception tristimulus data. Accordingly, an image displayed by the display device 1160 according to embodiments may be perceived to have a desired color by a user, and a metamerism failure may be prevented.

The inventive concepts may be applied to any display device 1160, and any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although embodiments have been described, those skilled in the art will readily appreciate that many modifications are possible to the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A gamma correction method that performs gamma correction for a display device, the gamma correction method comprising:

obtaining a plurality of correction matrices respectively corresponding to a plurality of spectrums of different test display devices;

measuring a spectrum of the display device;

selecting a correction matrix corresponding to the spectrum of the display device from the plurality of correction matrices;

measuring tristimulus data of the display device;

converting the measured tristimulus data into perception tristimulus data by using the selected correction matrix; and performing the gamma correction for the display device based on the perception tristimulus data.

2. The gamma correction method of claim 1, wherein obtaining the plurality of correction matrices includes:

displaying a reference color image by a reference display device;

adjusting image data for each of the test display devices such that each of the test display devices displays an image that is perceived to have a color identical to a color of the reference color image;

obtaining test measured tristimulus data for each of the test display devices; and obtaining the plurality of correction matrices respectively corresponding to the test display devices based on the test measured tristimulus data of each of the test display devices and reference tristimulus data corresponding to the reference color image.

3. The gamma correction method of claim 2, wherein each of the plurality of correction matrices is a matrix for converting the test measured tristimulus data of each of the test display devices into the reference tristimulus data.

4. The gamma correction method of claim 2, wherein each of the plurality of correction matrices is calculated by using an equation, "COR_MAT·T_MEA_XYZ=REF_XYZ", where COR_MAT is each of the plurality of correction matrices, T_MEA_XYZ is a matrix representing the test measured tristimulus data, and REF_XYZ is a matrix representing the reference tristimulus data.

5. The gamma correction method of claim 2, wherein each of the plurality of correction matrices is calculated by using an equation, "$COR_MAT=(T_MEA_XYZ^T \cdot T_MEA_XYZ)^{-1} \cdot T_MEA_XYZ^T \cdot REF_XYZ$", where COR_MAT is each of the plurality of correction matrices, T_MEA_XYZ is a matrix representing the test measured tristimulus data, and REF_XYZ is a matrix representing the reference tristimulus data.

6. The gamma correction method of claim 1, wherein selecting the correction matrix corresponding to the spectrum of the display device includes:

selecting the correction matrix from the plurality of correction matrices according to at least one of a peak wavelength, a full width at half maximum and a spectrum similarity of the spectrum of the display device.

7. The gamma correction method of claim 1, wherein the measured tristimulus data are converted into the perception tristimulus data by using an equation, "COR_MAT·MEA_XYZ=PCV_XYZ", where COR_MAT is the selected correction matrix, MEA_XYZ is a matrix representing the measured tristimulus data, and PCV_XYZ is a matrix representing the perception tristimulus data.

8. The gamma correction method of claim 1, wherein performing the gamma correction for the display device based on the perception tristimulus data includes:

determining whether the perception tristimulus data are within a target range;

obtaining again the perception tristimulus data by changing a gamma reference voltage of the display device when the perception tristimulus data are out of the target range; and generating gamma data representing the gamma reference voltage of the display device when the perception tristimulus data are within the target range.

9. A gamma correction system that performs gamma correction for a display device, the gamma correction system comprising:

a spectrum measurer configured to measure a spectrum of the display device;

a tristimulus measurer configured to measure tristimulus data of the display device; and a gamma correction device configured to store a plurality of correction matrices respectively corresponding to a plurality of spectrums of different test display devices, to select a correction matrix corresponding to the spectrum of the display device from the plurality of correction matrices, to convert the measured tristimulus data into perception tristimulus data by using the selected correction matrix, and to perform the gamma correction for the display device based on the perception tristimulus data.

10. The gamma correction system of claim 9, wherein the gamma correction device is further configured to:

store the plurality of correction matrices respectively corresponding to the plurality of spectrums;

select the correction matrix according to the spectrum of the display device;

convert the measured tristimulus data into the perception tristimulus data by using the selected correction matrix; and perform the gamma correction based on the perception tristimulus data.

11. The gamma correction system of claim 9, wherein test measured tristimulus data for each of the test display devices are obtained when each of the test display devices displays an image that is perceived to have a color identical to a color of a reference color image displayed by a reference display device, and wherein the plurality of correction matrices respectively corresponding to the test display devices is obtained based on the test measured tristimulus data of each of the test display devices and reference tristimulus data corresponding to the reference color image.

12. The gamma correction system of claim 11, wherein each of the plurality of correction matrices is a matrix for converting the test measured tristimulus data of each of the test display devices into the reference tristimulus data.

13. The gamma correction system of claim 11, wherein each of the plurality of correction matrices is calculated by using an equation, "COR_MAT·T_MEA_XYZ=REF_XYZ", where COR_MAT is each of the plurality of correction matrices, T_MEA_XYZ is a matrix representing the test measured tristimulus data, and REF_XYZ is a matrix representing the reference tristimulus data.

14. The gamma correction system of claim 11, wherein each of the plurality of correction matrices is calculated by using an equation, "COR_MAT= $(T_MEA_XYZ^T \cdot T_MEA_XYZ)^{-1} \cdot T_MEA_XYZ^T$ REF_XYZ", where COR_MAT is each of the plurality of correction matrices, T_MEA_XYZ is a matrix representing the test measured tristimulus data, and REF_XYZ is a matrix representing the reference tristimulus data.

15. The gamma correction system of claim 9, wherein the gamma correction device selects the correction matrix from the plurality of correction matrices according to at least one of a peak wavelength, a full width at half maximum and a spectrum similarity of the spectrum of the display device.

16. The gamma correction system of claim 9, wherein the gamma correction device converts the measured tristimulus data into the perception tristimulus data by using an equation, "COR_MAT·MEA_XYZ=PCV_XYZ", where COR_MAT is the selected correction matrix, MEA_XYZ is a matrix representing the measured tristimulus data, and PCV_XYZ is a matrix representing the perception tristimulus data.

17. The gamma correction system of claim 9, wherein the gamma correction device is further configured:

to determine whether the perception tristimulus data are within a target range;

to obtain again the perception tristimulus data by changing a gamma reference voltage of the display device when the perception tristimulus data are out of the target range; and to generate gamma data representing the gamma reference voltage of the display device when the perception tristimulus data are within the target range.

18. A display device comprising:

a display panel including a plurality of pixels;

a scan driver configured to provide scan signals to the plurality of pixels;

a data driver configured to provide data signals to the plurality of pixels;

a controller configured to control the scan driver and the data driver;

a sensor configured to measure a spectrum and tristimulus data of the display device; and a gamma correction device configured to store a plurality of correction matrices respectively corresponding to a plurality of spectrums of different test display devices, to select a correction matrix corresponding to the spectrum of the display device from the plurality of correction matrices, to convert the measured tristimulus data into perception tristimulus data by using the selected correction matrix, and to perform gamma correction for the display device based on the perception tristimulus data.

19. The display device of claim 18, wherein the gamma correction device is further configured to:

store the plurality of correction matrices respectively corresponding to the plurality of spectrums;

select the correction matrix according to the spectrum of the display device;

convert the measured tristimulus data into the perception tristimulus data by using the selected correction matrix; and perform the gamma correction based on the perception tristimulus data.

20. The display device of claim 18, wherein the gamma correction device converts the measured tristimulus data into the perception tristimulus data by using an equation, "COR_MAT·MEA_XYZ=PCV_XYZ", where COR_MAT is the selected correction matrix, MEA_XYZ is a matrix representing the measured tristimulus data, and PCV_XYZ is a matrix representing the perception tristimulus data.

* * * * *